United States Patent [19]

Haley et al.

[11] Patent Number: 4,830,104

[45] Date of Patent: May 16, 1989

[54] ACTUATION INDICATOR FOR DOWNHOLE TOOLS

[75] Inventors: Jerry L. Haley, Richardson; Dennis R. Wood, Plano, both of Tex.

[73] Assignee: Atlantic Richfield Company, Los Angeles, Calif.

[21] Appl. No.: 121,553

[22] Filed: Nov. 17, 1987

[51] Int. Cl.[4] ..... E21B 23/03

[52] U.S. Cl. ..... 166/214; 166/217

[58] Field of Search ..... 166/211, 214, 215, 216, 166/217, 241

[56] References Cited

U.S. PATENT DOCUMENTS

| | | | |
|---|---|---|---|
| 2,924,278 | 2/1960 | Garret et al. | 166/214 |
| 2,991,835 | 7/1961 | Schwab | 166/214 |
| 4,616,703 | 10/1986 | Laurent et al. | 166/214 X |

*Primary Examiner*—Jerome W. Massie
*Assistant Examiner*—Matthew Smith
*Attorney, Agent, or Firm*—Michael E. Martin

[57] ABSTRACT

A mechanical indicator and arresting apparatus for use with downhole tools which are extendable through wellbore tubing strings by a wireline cable or the like. The indicator apparatus includes a body supporting an elongated actuating rod which is movable longitudinally by an actuator member associated with the tool to extend a plurality of arresting fingers which are pivotally mounted on the body member from a retracted position, which permits movement of the indicator through the tubing string, to an extended position for engaging a transverse surface on the tubing string to arrest movement of the indicator in at least one direction of movement through the tubing string. The actuating rod includes a latch member for holding the fingers in a retracted position and a spring biased plunger is engageable with the fingers to move the fingers to their extended position in response to movement of the actuating rod.

6 Claims, 2 Drawing Sheets

ACTUATION INDICATOR FOR DOWNHOLE TOOLS

FIELD OF THE INVENTION

The present invention pertains to a mechanical indicator for placement in a wellbore with a downhole tool for indicating the actuation of the tool, such as a wellbore fluid sampling device.

BACKGROUND

Various types of downhole tools are conveyed into a wellbore on a wireline or similar cable for operation once a predetermined depth or position of the tool in the wellbore is reached. Since such tools must often be lowered through several thousand feet of wellbore, it is desirable to have a positive indication of when the tool has been actuated so that the intended operation of the tool may be carried out. Moreover, if the tool is inadvertently actuated prematurely, positive indication of this event is desirable to minimize time in retrieving the tool for correction of the fault.

One type of tool which is adapted for mechanical actuation upon reaching a predetermined depth is a wellbore fluid sampling apparatus. Various types of wellbore fluid sampling devices are known which are actuated upon reaching a predetermined position in the wellbore to trap a fluid sample in a closable chamber so that the sample may be retrieved for analysis at the surface. In this regard, there has been a need for a mechanically uncomplicated and reliable device which will give a positive indication at the surface that certain events have taken place in connection with operation of the sampler or similar downhole tools in order to confirm that the intended operation of the tool has been carried out or to alert the tool operator to the fact that a premature or unwanted actuation of the tool has occurred so that retrieval of the tool can be effected with minimum loss of time and effort. The present invention provides such an improved and unique device as will be appreciated by those skilled in the art upon reading the further description set forth herein.

SUMMARY OF THE INVENTION

The present invention provides an improved indicator apparatus for use in conjunction with downhole wellbore tools such as wellbore fluid samplers and similar devices which are adapted to be actuated in a wellbore at a predetermined depth. In accordance with one important aspect of the present invention, an indicator apparatus is provided which, upon lowering the indicator apparatus and an associated tool or actuator through a wellbore, the indicator is arrested upon reaching a point in the wellbore such as a tubing joint or a similar discontinuity in the sidewall of a tubing or other structure defining a passageway in a tubing string and related components.

In accordance with another important aspect of the present invention, a mechanical indicator apparatus is provided which, upon actuation, prevents further downward movement of the apparatus and associated mechanism connected thereto through a wellbore but permits retrieval of the apparatus from the wellbore. In particular, the apparatus includes plural retractable fingers which are adapted to engage a generally transverse surface formed on one end of a tubing section or on similar components connected to a tubing string. The retractable fingers are secured in a retracted position until an actuating mechanism associated with the wellbore tool is tripped at which time the fingers are urged radially outwardly into engagement with the inner wall of the tubing or similar passageway providing structure and, upon engagement with a generally transverse surface, the indicator mechanism is arrested from further movement downhole.

The above-described advantages and features of the present invention together with other superior aspects thereof will be further appreciated by those skilled in the art upon reading the detailed description which follows.

BRIEF DESCRIPTION OF THE DRAWING

FIG. 1 is a view, in somewhat schematic form, showing the apparatus of the present invention in a wellbore and connected in a string of tool components suspended from a wireline cable or the like;

DESCRIPTION OF A PREFERRED EMBODIMENT

Figure 1:
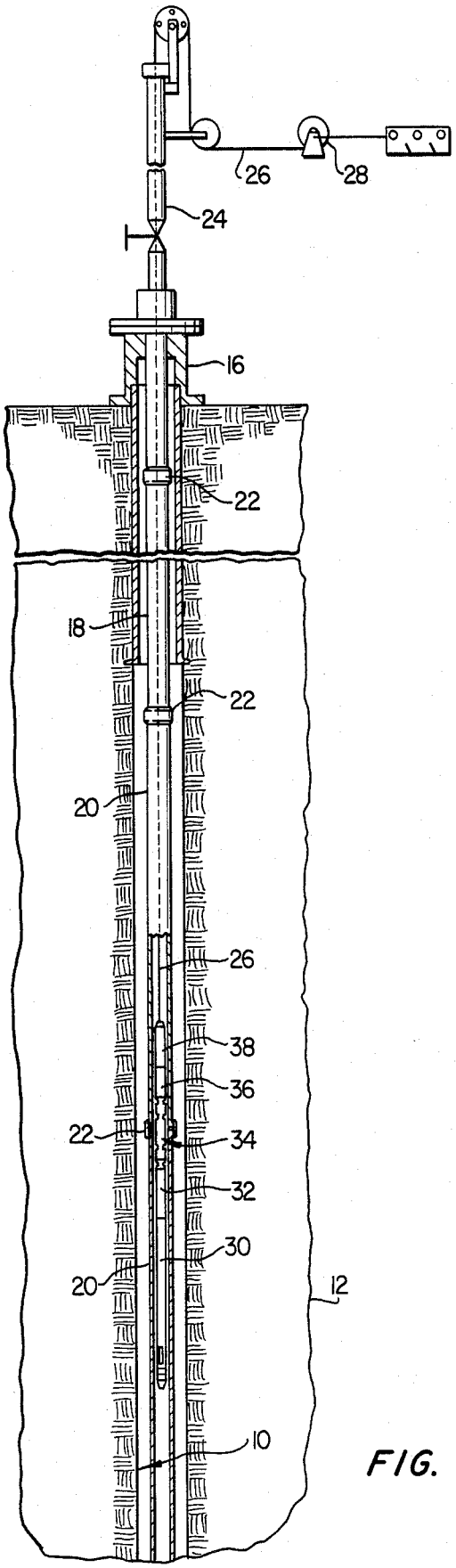

In the description which follows, like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, there is illustrated in somewhat schematic form a wellbore 10 which has been drilled into a formation 12, is at least partially cased by a casing 14 and is provided with a wellhead 16 of conventional construction. A tubing string 18 extends within the wellbore 10 and is made up of end to end sections of tubing 20 which are connected by conventional coupling members 22. The tubing string 18 is in communication with a conventional wireline lubricator 24 through which a wireline or similar flexible cable 26 extends from a drum or reel 28 on the surface and into and through the tubing string 18.

In the arrangement illustrated in FIG. 1, a downhole tool such as a wellbore fluid sampler 30 is disposed within the tubing string 18 and is suspended from the wireline 26 by way of a suitable actuator device 32, an actuating indicator 34 in accordance with the present invention, an actuator tripping device 36 and a connector or so-called rope socket 38 which is connected directly to the lower end of the wireline 26. In the operation of certain downhole tools such as the fluid sampler 30, the sampler is lowered into the wellbore 10, which may extend several thousand feet from the wellhead 16, and through operation of a suitable tripping mechanism or trigger in the unit 36, the actuator 32 energizes the sampler to capture a sample of wellbore fluid. Since the desired point of sampling the wellbore fluid may be several thousand feet below the surface, it is desirable to verify that operation of the tripping mechanism 36 and the actuator 32 has occurred to effect operation of the sampler before the sampler is retrieved. During the period of time required to insert the sampler 30 or a similar tool, into the wellbore 10 and in the desired position is also highly desirable to be able to verify whether or not the actuator 32 prematurely energized the sampler 30. In this regard, the unique actuator indicator 34 is particularly adapted to provide a positive mechanical indication to the tool operator on the surface if tripping of the actuator has occurred. The indicator 34 may be adapted to be operated with several types of tripping methods and actuators and for the sake of discussion herein a brief description of an actuator means and an actuator tripping device or clock is provided.

Figure 2A:
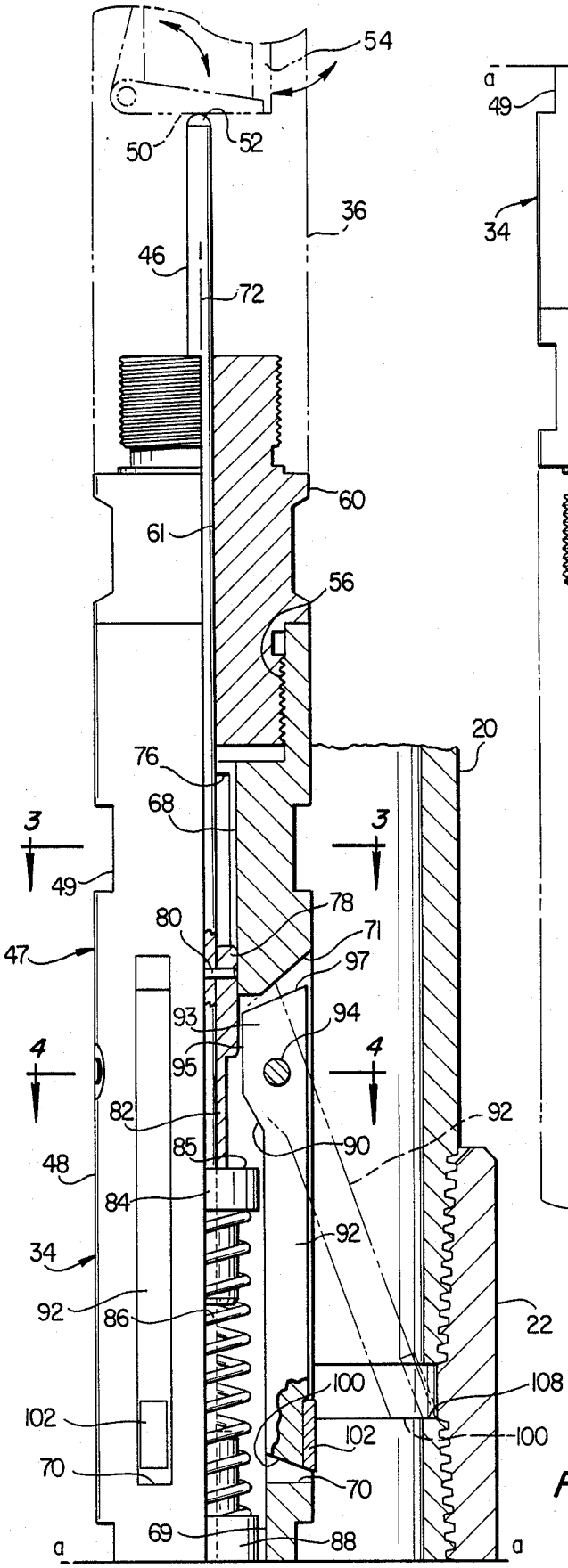
FIG. 2A is a longitudinal, central, half-section view of the indicator apparatus of the present invention.
Figure 2B:
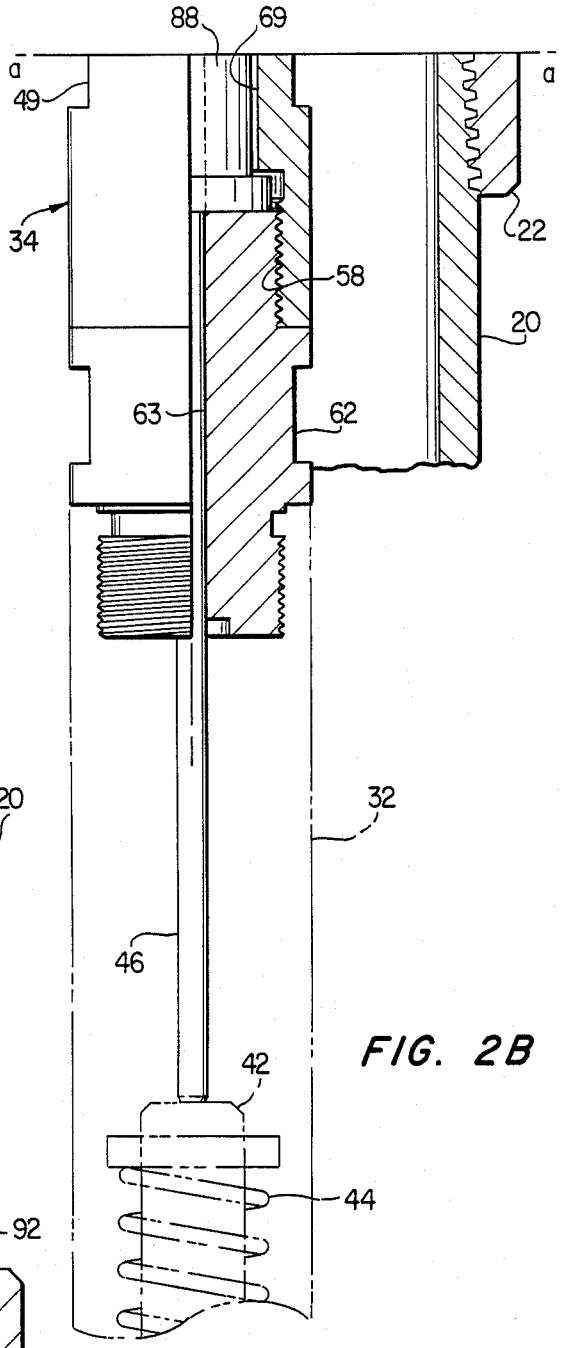
FIG. 2B is a continuation of FIG. 2A from the line a—a.

Referring primarily to FIGS. 2A and 2B, the actuator 32 may, for example, include an actuating plunger 42 which is biased by a coil spring 44 to move upward, viewing FIG. 2B, to move an elongated actuating rod 46 of the indicator 34. The rod 46 is an elongated member which extends from opposite ends of a generally cylindrical housing assembly 47 of the indicator 34 and is also engageable by a trigger member 50 of the mechanism 36. The trigger member 50 is mounted for pivotal movement clear of the upper end 52 of the rod in response to movement of a latch member 54 out of its latching position as shown in FIG. 2. Those skilled in the art will recognize that various other types of trigger or release mechanisms and actuator mechanisms may be used in conjunction with the actuating indicator 34. The tripping mechanism 36 may, for example, be a device known as a driving clock manufactured by Leutert Instruments, Inc., Houston, Texas. The combination of the driving clock or tripping mechanism 36 and the indicator 34 may be used in conjunction with various downhole tools and associated actuating mechanisms, but is particularly useful with a wellbore fluid sampler and an associated actuator having a mechanical element which moves in the direction indicated in FIG. 2 in response to the rod 46 being free to move upward, as illustrated.

Referring further to FIGS. 2A and 2B, the housing assembly 47 includes a generally cylindrical body or housing member 48 having opposed internally threaded end portions 56 and 58 into which opposed threaded head members 60 and 62 are respectively secured. The head members 60 and 62 include central longitudinal bores 61 and 63, respectively for receiving the cylindrical actuating rod 46 for axial slidable movement therein. The body member 48 is preferably a generally cylindrical member having spaced apart opposed sets of wrench engaging flats 49 and an elongated central bore 68 which opens to three elongated radially extending slots 70, see FIG. 4 also, which are disposed at angles of approximately 120 degrees from each other with respect to a longitudinal central axis 72 of the indicator 34. An enlarged bore portion 69 extends from the slots 70 to the internally threaded end 58 of the body member 48.

Figure 3:
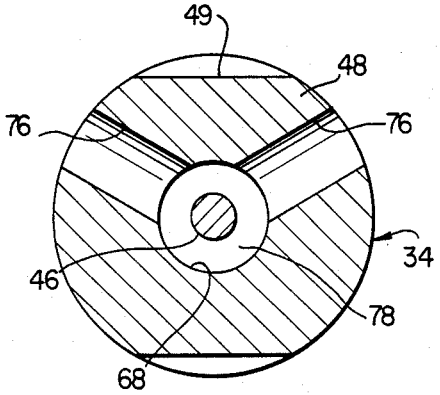
FIG. 3 is a section view taken generally along the line 3—3 of FIG. 2A.

As shown in FIGS. 2A and 3, at least two elongated slots 76 also extend radially from the exterior of the body member 48 to intersect the bore 68. The slots 76 extend longitudinally over the length of travel of the rod member 46 during its normal operation to prevent trapping fluid in the bore 68 between a generally cylindrical latch member 78 and the head member 60 to thereby allow unrestricted movement of the latch member in the bore. The latch member 78 is slidably disposed in the bore 68 in relatively close fitting relationship thereto and is secured to the rod 46 by a retaining pin 80, FIG. 2A, extending transversely through the rod and the latch member. The latch member 78 includes an integral spacer portion 82 which extends in sleeved relationship over the rod 46 and is engageable with a generally cylindrical plunger member 84 which is disposed on and movable relative to the rod 46. The plunger 84 is movable relative to the housing 48 and is engaged with one end of a coil compression spring 86. The opposite end of the compression spring 86 is engaged with a plug member 88 disposed in the bore portion 69 and retained therein by the head member 62. The rod 46 is slidably disposed within and extends through the plug member 88. The plunger 84 is also adapted for movement relative to the rod 46.

Figure 4:
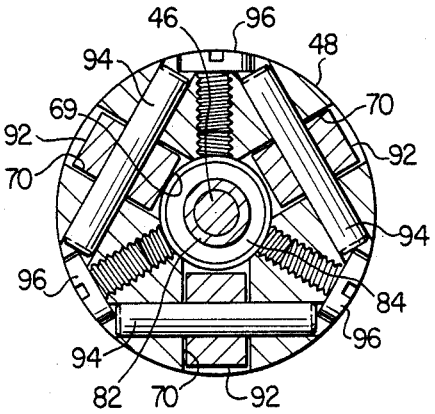
FIG. 4 is a section view taken generally along the line 4—4 of FIG. 2A.

The periphery of the upper transverse face 85, FIG. 2A, of the plunger 84 comprises a cam surface for engagement with a cooperating cam follower surface 90 formed on each of plural arresting fingers 92 which are each secured to the housing member 48 within the respective slots 70, see FIGS. 2A and 4, by support pins 94 disposed in cooperating transverse bores in the housing member. The pins 94 are each retained in their respective bores by removable fastener members 96 comprising panhead machine screws, for example. The arresting fingers 92 each include a distal end 100 on which a hard metal wear resistant insert 102 is secured on the radially outward facing surface of the fingers for engagement with the inner wall surfaces of the tubing sections 20. A hub portion 93 of each of the fingers 92 is delimited by intersecting surfaces 95 and 97 which engage the latch member 78 and a cooperating surface 71 in each of the slots 70, respectively, for limiting the movement of the arresting fingers about the pivot axis formed by the pins 94.

As shown in FIG. 2A, when the arresting fingers 92 have been deployed so that their distal ends 100 extend radially outwardly away from the axis 72, these ends are engageable with a transverse surface 108 formed on the ends of each of the respective tubing sections 20 as the indicator 34 moves downward, viewing FIG. 2A, through the tubing string 18. In conventional oil and gas well tubing strings a transverse surface is typically formed at the upper end o the tubing sections when coupled together by a separate coupling section 22 or, if the tubing sections have integral upset internally threaded "box" portions, a sufficiently large transverse surface is usually also formed to be engageable by the fingers 92. Those skilled in the art will recognize that the indicator 34 will also be operable to engage other transverse or nearly transverse surfaces formed on other downhole components of a tubing string.

When the actuator rod 46 and the latch member 78 are in the position shown in FIG. 2A, the fingers 92 are retained in their retracted positions in the slots 70 by the latch member 78 being in close proximity to the cam surfaces 95 on the fingers, respectively. The plunger 84 is disposed in the position shown adjacent to the cam follower surfaces 90. If the trigger member 50 is moved to a position clear of the upper end 52 of the rod 46, the actuator plunger 42 will urge the rod upwardly, viewing FIG. 2A, to move the latch member 78 within the bore 68. The latch member 78 and plunger 84 will move a short distance until the latch member is clear of the surfaces 95 so that the fingers 92 can begin rotation. The spring 86, urges the plunger 84 upward into engagement of the cam follower surfaces 90 on the respective fingers 92 and the fingers are thus urged to pivot outwardly into the alternate position, shown by example in FIG. 2A, under the urging of the spring 86 and the plunger 84 until the surfaces 97 engage the surfaces 71 delimiting the respective slots 70. The fingers 92 are urged outwardly sufficiently that the distal ends 100 will engage the inner wall of the tubing sections 20 and eventually engage a transverse surface 108 as the indicator 34 moves downward in the tubing string 18.

Once the fingers 92 have engaged a surface such as the surface 108, the indicator 34 and any apparatus connected thereto will be arrested from further movement downward in the tubing string 18 and slack in the wireline 26 will indicate that the actuator 32 has been energized whether deliberately or inadvertently. Completion of operation of the tool such as the sampler 30 may then be carried out and the wireline retrieved up through the tubing string with the fingers 92 radially extended. The fingers 92 will remain in engagement with the side walls of the tubing string as the assembly of the tool 30, actuator 32, indicator 34 and trigger mechanism 36 is moved upward in the wellbore. Thanks to the provision of the hardfaced inserts 102, substantial rubbing action of the distal ends 100 of the fingers 92 against the inner surfaces of the tubing string will not cause undue wear on the fingers.

When the assembly of the tool 30 and the associated apparatus coupled thereto is removed from the tubing string at the lubricator 24, the fingers 92 may be reset to their retracted position by moving the rod 46 downwardly while pivoting the fingers radially inwardly into the slots 70 until the latch member 78 is positioned adjacent the surfaces 95 in the position shown in FIG. 2A. When the plunger 84 is moved to the position shown in FIG. 2A it prevents further inward pivotal movement of the fingers 92 into the slots 70 and unwanted engagement of the spring 86 by the finger ends 100. In this position, the rod 46 is not urged to move in either direction since the urging of the plunger 84 against the cam surfaces 90 will not bring about pivotal movement of the fingers 92 radially outwardly due to the presence of the latch member 78 in the position shown. Of course, when the rod member 46 is moved by external forces in an upward direction to cause the latch member 78 to move clear of the cam surfaces 95, the plunger 84 is free to pivot the distal ends 100 of the fingers 92 to their extended position for arresting downward movement of the indicator. Those skilled in the art will recognize that various latching and actuating mechanisms may be used in conjunction with the indicator 34 to effect movement of the rod 46, as desired.

The operation of the indicator 34 is believed to be apparent from the foregoing description. The indicator 34 may be manufactured of conventional engineering materials and fabrication techniques. Although a preferred embodiment of the invention has been described herein in detail, those skilled in the art will recognize that various substitutions and modifications may be made without departing from the scope and spirit of the invention as recited in the appended claims.

What is claimed is:

1. An indicator apparatus for use in conjunction with operating downhole tools insertable within a tubing string or the like, said tubing string having means forming at least one generally transverse surface within passage means formed by said tubing string, said indicator apparatus comprising:

a body member adapted to be connected to actuator means;

an elongated actuating rod supported on said body member and having a portion engageable with an actuator member of said actuator means for movement thereby from a first position to a second position;

arresting means mounted on said body member and movable from a retracted position to an extended position for engaging said surface to arrest movement of said apparatus in one direction in said tubing string but to permit movement of said apparatus in the opposite direction in said tubing string;

a latch member connected to said actuating rod and engageable with said arresting means for retaining said arresting means in a retracted position in said first position of said actuating rod, said latch member being movable with said actuating rod to permit movement of said arresting means toward said extended position;

plunger means responsive to movement of said actuating rod toward said second position for moving said arresting means from said retracted position to said extended position; and spring means disposed on said apparatus for urging said plunger means toward engagement with said arresting means for moving said arresting means from said retracted position to said extended position for engaging said surface, said plunger means and said spring means being cooperable with said arresting means to permit movement of said arresting means toward said retracted position upon movement of said apparatus in said opposite direction.

2. The apparatus set forth in claim 1 wherein:

said arresting means comprises a plurality of arresting fingers having distal end portions movable from said retracted position to said extended position for engagement of said surface.

3. The apparatus set forth in claim 2 wherein:

said arresting fingers are supported by said body member for pivotal movement about respective pivot means between said retracted position and said extended position.

4. The apparatus set forth in claim 2 wherein:

said arresting fingers are disposed in circumferentially spaced slot means formed on said body member.

5. The apparatus set forth in claim 4 wherein:

said arresting fingers include surface means engageable with said body member to limit the movement of said arresting fingers toward said extended position.

6. Indicator apparatus for use in conjunction with a downhole tool for insertion within a tubing string in a wellbore wherein said tubing string includes means forming a transverse surface facing interior passage means of said tubing string, said apparatus comprising:

an elongated body member having a longitudinal bore extending therethrough;

an elongated actuating rod extending within said bore and supported on said body member for movement with respect to the longitudinal central axis of said body member, said actuating rod being engageable with actuator means operably connected to said indicator apparatus;

a plurality of arresting fingers mounted on said body member for pivotal movement between a retracted position to permit movement of said indicator apparatus through said tubing string and an extended position for engagement with said surface to arrest movement of said indicator apparatus through said tubing string in one direction but to permit movement of said indicator apparatus through said tubing string in the opposite direction, said fingers each including cam surface means thereon;

a latch member associated with said actuating rod and engageable with said fingers for holding said fingers in a retracted position in a first position of said actuating rod and operable to permit movement of said fingers in a second position of said actuating rod;

a plunger disposed in sleeved relationship on said actuating rod and including cam means engageable with said cam surface means on said fingers; and spring means operably engaged with said plunger for urging said plunger to move said fingers to said extended position in response to movement of said actuating rod from said first position to said second position for engagement of said fingers with said surface to arrest movement of said indicator through said tubing string, said plunger and said spring means being operable to permit movement of said fingers toward said retracted position in response to movement of said indicator apparatus in said opposite direction.

* * * * *